US009701529B2

(12) United States Patent
Ito

(10) Patent No.: US 9,701,529 B2
(45) Date of Patent: Jul. 11, 2017

(54) METHOD AND APPARATUS FOR COOLING A STORAGE CONTAINER FOR LIQUID

(75) Inventor: Russ Ito, Honolulu, HI (US)

(73) Assignee: RJ Enterprise, LLC, Honolulu, HI (US)

( * ) Notice: Subject to any disclaimer, the term of this patent is extended or adjusted under 35 U.S.C. 154(b) by 1197 days.

(21) Appl. No.: 13/168,862

(22) Filed: Jun. 24, 2011

(65) Prior Publication Data

US 2012/0325856 A1 Dec. 27, 2012

(51) Int. Cl.

| | |
|---|---|
| ***B67D 1/00*** | (2006.01) |
| ***B67D 1/04*** | (2006.01) |
| ***B67D 1/08*** | (2006.01) |
| ***F25D 3/00*** | (2006.01) |
| ***F25D 3/08*** | (2006.01) |
| *F25D 31/00* | (2006.01) |
| *F25D 3/06* | (2006.01) |

(52) U.S. Cl.

CPC ..... *B67D 1/0857* (2013.01); *B67D 1/04* (2013.01); *B67D 2210/00133* (2013.01); *F25D 3/06* (2013.01); *F25D 3/08* (2013.01); *F25D 31/006* (2013.01); *F25D 2303/081* (2013.01); *F25D 2331/802* (2013.01); *F25D 2331/809* (2013.01)

(58) Field of Classification Search

CPC ..... B67D 1/0857; B67D 2210/00133; B67D 1/04; F25D 2331/802; F25D 2331/809; F25D 3/06; F25D 3/08; F25D 31/006; F25D 2303/081

USPC ..... 222/146.6, 146.1, 131, 399, 400.7, 608, 222/386.5, 183; 62/389, 393, 395, 398, 62/400, 449, 457.1, 459

See application file for complete search history.

(56) References Cited

U.S. PATENT DOCUMENTS

| | | | | |
|---|---|---|---|---|
| 2,080,598 | A * | 5/1937 | Bodenstab | 62/464 |
| 2,792,692 | A | 5/1957 | Bryan | |
| 2,917,906 | A * | 12/1959 | Woolley | 62/306 |
| 3,308,636 | A * | 3/1967 | Schaaf | 62/400 |
| 3,354,668 | A * | 11/1967 | Cserny | 62/449 |
| 3,789,622 | A * | 2/1974 | Yanes | 62/396 |
| 4,071,160 | A * | 1/1978 | Vick | 220/592.2 |
| 4,164,853 | A * | 8/1979 | McDonough | 62/457.1 |
| 4,174,811 | A * | 11/1979 | Binder et al. | 239/308 |
| 4,220,048 | A * | 9/1980 | Grepiotis et al. | 73/323 |
| 4,481,791 | A | 11/1984 | German | |
| 4,633,678 | A * | 1/1987 | Lea et al. | 62/457.1 |
| 4,963,175 | A * | 10/1990 | Pace | 62/372 |
| 5,282,561 | A | 2/1994 | Mihalich | |
| 5,339,986 | A * | 8/1994 | Mihalich | 222/1 |
| 5,361,605 | A * | 11/1994 | Pizzi et al. | 62/530 |
| 5,385,275 | A * | 1/1995 | Billet | 222/399 |
| 5,467,877 | A * | 11/1995 | Smith | 215/11.1 |
| 5,555,746 | A * | 9/1996 | Thompson | 62/457.4 |
| 5,573,141 | A * | 11/1996 | Chen | 62/457.3 |
| 5,875,646 | A * | 3/1999 | Rich | 62/457.3 |
| 6,105,825 | A * | 8/2000 | Gomi et al. | 222/146.6 |
| 6,415,623 | B1 * | 7/2002 | Jennings et al. | 62/457.2 |

(Continued)

OTHER PUBLICATIONS

"Robo Keg Cooler," Kegworld.Com., http://www.kegworld.com/mobile-dispensers.htm,, pp. 1-2, printed on Apr. 20, 2011.

*Primary Examiner* — Frederick C Nicolas

(74) *Attorney, Agent, or Firm* — DLA Piper LLP (US)

(57) ABSTRACT

The invention relates generally to a method and apparatus for cooling a storage container for liquid.

7 Claims, 4 Drawing Sheets

(56) References Cited

U.S. PATENT DOCUMENTS

| | | | | |
|---|---|---|---|---|
| 6,481,238 | B1 * | 11/2002 | Jennings et al. | 62/457.4 |
| 6,648,177 | B2 * | 11/2003 | Burger | 222/108 |
| 6,651,845 | B1 * | 11/2003 | Schroeder | 222/83 |
| 6,695,177 | B2 * | 2/2004 | Blicher | 222/396 |
| 6,751,981 | B1 * | 6/2004 | Burnette | 62/457.2 |
| 6,783,034 | B1 * | 8/2004 | Brent | 222/183 |
| 7,032,781 | B2 * | 4/2006 | Van Der Klaauw et al. | 222/146.6 |
| 7,100,393 | B2 * | 9/2006 | D'Angelo | 62/372 |
| 7,246,727 | B2 * | 7/2007 | Magermans et al. | 222/529 |
| 7,661,556 | B2 * | 2/2010 | van der Klaauw et al. | 222/1 |
| 7,721,567 | B2 * | 5/2010 | Dalton et al. | 62/389 |
| 7,757,908 | B1 * | 7/2010 | Buhl, Jr. | 222/608 |
| 7,770,410 | B2 * | 8/2010 | Cote | 62/457.4 |
| 7,992,487 | B1 * | 8/2011 | Kahl | 99/275 |
| 2004/0065109 | A1 * | 4/2004 | Metcalf | 62/457.3 |

* cited by examiner

METHOD AND APPARATUS FOR COOLING A STORAGE CONTAINER FOR LIQUID

FIELD OF THE INVENTION

The invention relates generally to a method and apparatus for holding and cooling a storage container for liquid.

BACKGROUND OF THE INVENTION

Storage containers for liquids are well-known. For example, kegs are often used to store beer. Other types of tanks are used to store soda. There usually is a need to chill the storage container to keep its contents cool. For example, when kegs are used to dispense beer, it is desirable to chill the keg so that the beer is cold when served. In addition, keg beer typically needs to be chilled because the beer will become spoiled otherwise.

In the prior art, people tried various methods for cooling beer kegs and other containers for liquids. One common practice was to place the beer keg in another container, such as a large bucket, and fill the area around the beer keg within the container with ice. The container usually will become too heavy for one person to carry, since the beer keg and ice have substantial mass. In addition, once the ice begins to melt, there is no way to drain the water except to tip the entire container over to drain the water from the top opening. This is cumbersome and sometimes dangerous.

Another common practice is to place the beer keg in a refrigerator and remove it as needed to dispense beer, which is often inconvenient. In addition, once the keg is out of the refrigerator, there is no system to chill it, and the beer's temperature will slowly increase until it matches the ambient temperature of the air surrounding the keg.

What is needed is a device for cooling beer kegs and other storage containers for liquid, where the device itself is mobile and can easily be transported by an ordinary person and where the device is thermally insulated and can accommodate ice around the storage container to increase the amount of time in which the storage container will be chilled. What is further needed is a way to drain water from the device as the ice melts without tilting the container.

SUMMARY OF THE INVENTION

Embodiments are disclosed for a thermally insulated device to store and chill a storage container, where the device optionally comprises handles and wheels for transport, a drain to release water, a lid for providing further thermal insulation, a tap on the outside of the device, and a hose for connecting from the tap to the storage container.

DETAILED DESCRIPTION OF A PREFERRED EMBODIMENT

Figure 1:
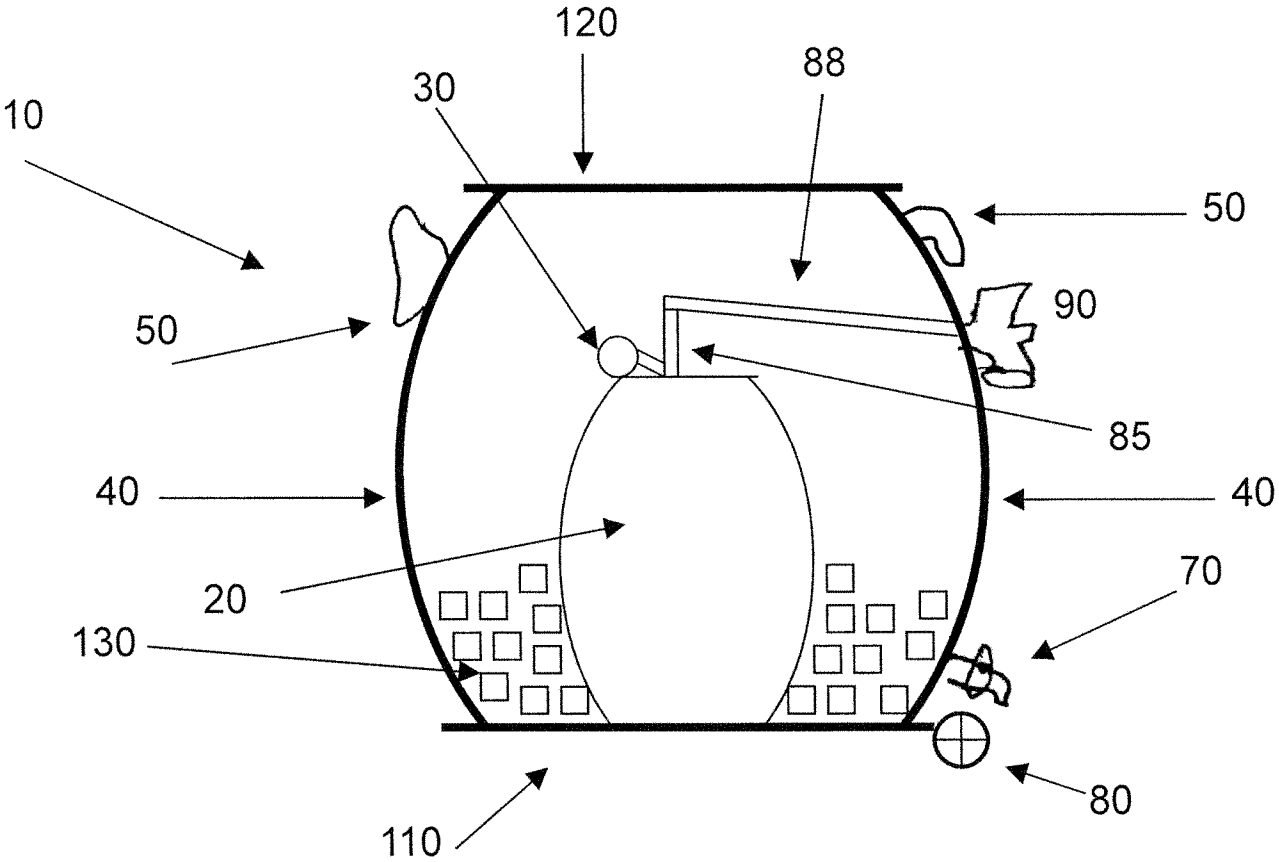
FIG. 1 illustrates a side-view of one embodiment of a storage device.

FIG. 1 depicts an embodiment. Storage device 10 is used to hold storage container 20. Storage container 20 optionally is a beer keg or other container for storing liquid. Storage container 20 optionally is coupled to an air tank 30 for inserting carbon dioxide, nitrogen, or another gas into storage container 20 to maintain the internal pressure of storage container 20 to assist in the dispensing of liquid from storage container 20. Storage container 20 optionally comprises stent 85 for transporting liquid from storage container 20 and hose 88 connected to stent 85 for transporting liquid from stent 85. Storage device 10 optionally comprises tap 90, which is mounted to the side walls 40 of storage device 10 and mates with hose 88. Thus, the liquid contents of storage container 20 can be dispensed through tap 90. Ice 130 can be placed into storage device 10 so that storage container 20 is at least partially surrounded by ice 130.

Storage device 10 comprises side walls 40, bottom member 110, and top member 120. Side walls 40, bottom member 110, and top member 120 preferably are comprised of thermally insulative material, such as plastic, carbon, wood, or foam. Side walls 40, bottom member 110, and top member 120 optionally can be double-walled, which has the benefit of keeping the contents colder while minimizing the formation of condensation on the outer surfaces.

Figure 3:
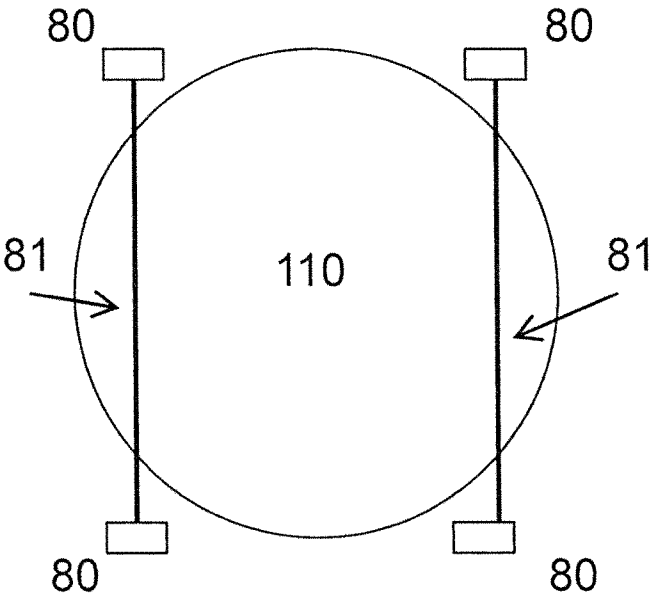
FIG. 3 illustrates four wheels attached to two axles attached to a bottom member.

Storage device 10 optionally comprises one or more handles 50 and wheels 80. Wheels 80 can comprise two wheels, each mounted separately onto side walls 40 or bottom member 110, or two wheels mounted to an axle (not shown) which in turn is mounted to side walls 40 or bottom member 110. Wheels 80 alternatively can comprise four wheels, each mounted separately onto side walls 40 or bottom member 110, or as shown in FIG. 3, two sets of two wheels mounted to axle 81, with each axle 81 in turn mounted to side walls 40 or bottom member 110. Storage device 10 can be transported by an ordinary user by lifting or pulling one or more handles 50 and rolling storage device 10 using wheels 80.

Figure 4:
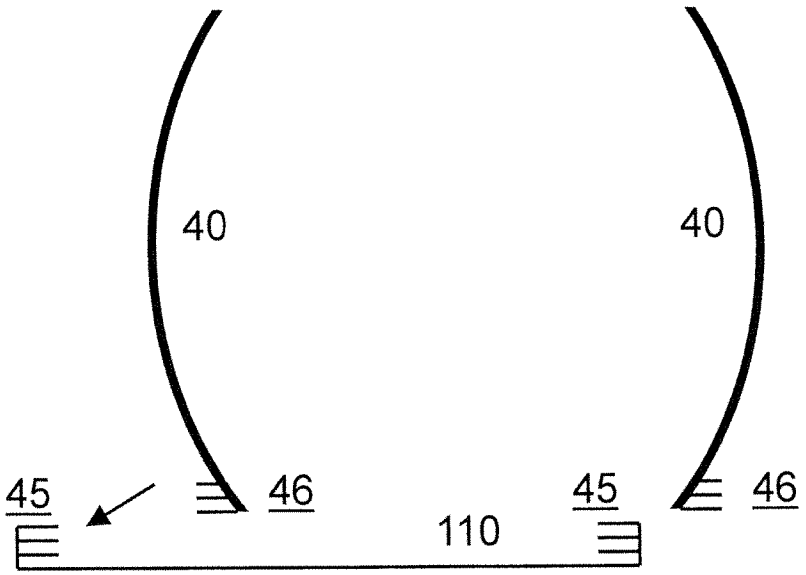
FIG. 4 illustrates a bottom member with threads for connecting to side walls with threads.

One or both of bottom member 110 and top member 120 are removable from side walls 40. Bottom member 110 and top member 120 optionally can attach to side walls 40 using well-known latching mechanisms, snap mechanisms, or screw mechanisms. For example, as shown in FIG. 4, bottom member 110 and/or top member 120 can comprise threads 45 that mate with threads 46 on side walls 40, such that bottom member 110 and/or top member 120 screw onto side walls 40. When this is implemented for bottom member 110, there is an added benefit of being able to insert storage container 110 onto bottom member 110, and then screwing bottom member 110 and side walls 40 together, thus eliminating the need to lift storage container 110 and place it into storage device 10. In the alternative, one of bottom member 110 and top member 120 can be permanently affixed to side walls 40, such as by well-known adhesives or by being formed as one piece with side walls 40 during the manufacturing process.

Storage device 10 optionally includes one or more drains 70 for draining water or other liquid from storage device 10 without pumping the water out or tipping over storage device 10 to remove the water or other liquid from the top. Drains 70 optionally can include a two-way valve, which can either drain directly to the ground or can be connected to a hose (not shown). Thus, when ice 130 melts into water, the water can be drained easily by a user from storage device 10, without tipping or moving storage device 10.

All of the components of storage device 10 optionally can be removable, which would result in easier transportation of storage device 10 (such as when it is hauled in a car or truck) and would make it easier for a user to clean the components.

For instance, it would be desirable to be able to remove and clean stent 85, hose 88, and tap 90 after use.

Storage device 10 has the added benefit of being discreet in appearance when compared to an ordinary beer keg. This may be a valuable feature for consumers at sporting events or public gatherings.

The embodiment described above has the added benefit of being an "all-in-one" system where all components are contained within a single device (storage device 10).

Side walls 40 and/or top member 120 optionally include one or more openings (such as a small hatch, not shown) through which a user can add ice 130 to storage device 10.

Figure 2:
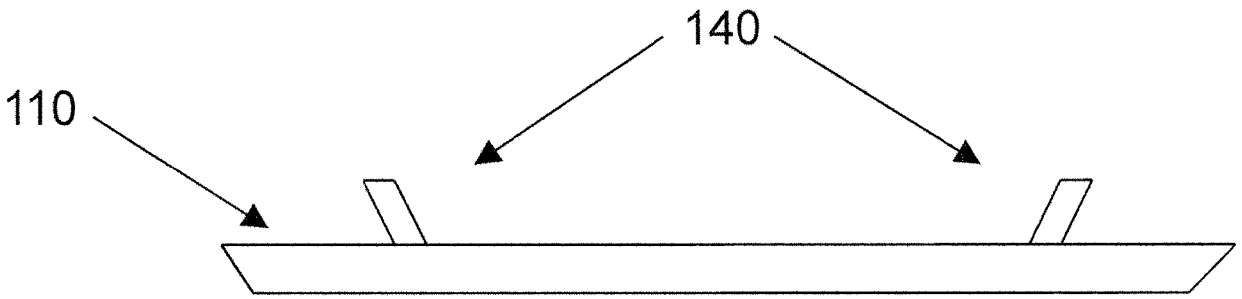
FIG. 2 illustrates a side-view of one embodiment of a bottom member of a storage device.

FIG. 2 shows a side-view of one embodiment of bottom member 110. Bottom member 110 optionally includes one or more protrusions 140 for receiving storage container 20, such as a raised circular member on the side of bottom member 110 that faces storage container 20. The raised circular member receives storage container 20 and minimizes the lateral movement of storage container 20 within storage device 10 when storage device 10 is transported or tilted.

While the foregoing has been with reference to particular embodiments of the invention, it will be appreciated by those skilled in the art that changes in these embodiments may be made without departing from the principles and spirit of the invention, the scope of which is defined by the appended claims.

The invention claimed is:

1. An apparatus for cooling and dispensing beer, comprising:

side walls coupled to a top member and a bottom member, wherein the bottom member comprises one or more protrusions for minimizing movement of the storage container in a direction parallel to the bottom member;

one or more handles attached to the side walls;

two or more wheels attached to one or more of the side walls and bottom member;

a storage container within the side walls containing beer and comprising an air tank;

a tap connected to the storage container for dispensing the beer;

ice surrounding at least a portion of the storage container; and a drain attached to one or more of the side walls and bottom member for draining water from the apparatus when the ice melts.

2. The apparatus of claim 1, wherein the bottom member is round and the protrusion comprises a raised circular member that receives the storage container.

3. The apparatus of claim 2, wherein the side walls, top member, and bottom member are constructed from plastic.

4. The apparatus of claim 1, wherein the top member is removable from the side walls.

5. The apparatus of claim 1, wherein the bottom member is removable from the side walls.

6. The apparatus of claim 1, wherein the top member and bottom member are removable from the side walls.

7. The apparatus of claim 1, wherein the bottom member is coupled to the side walls by a screw mechanism.

* * * * *